US010577139B2

(12) United States Patent
Nitsch et al.

(10) Patent No.: US 10,577,139 B2
(45) Date of Patent: Mar. 3, 2020

(54) APPARATUS FOR FORMING PACKAGING UNITS

(71) Applicant: KHS GmbH, Dortmund (DE)

(72) Inventors: Thomas Nitsch, Kleve (DE); Stefan Van Heukelum, Kranenburg (DE)

(73) Assignee: KHS GmbH, Dortmund (DE)

( * ) Notice: Subject to any disclaimer, the term of this patent is extended or adjusted under 35 U.S.C. 154(b) by 127 days.

(21) Appl. No.: 15/763,166

(22) PCT Filed: Aug. 4, 2016

(86) PCT No.: PCT/EP2016/068707
§ 371 (c)(1),
(2) Date: Mar. 26, 2018

(87) PCT Pub. No.: WO2017/050475
PCT Pub. Date: Mar. 30, 2017

(65) Prior Publication Data

US 2018/0237178 A1 Aug. 23, 2018

(30) Foreign Application Priority Data

Sep. 25, 2015 (DE) ..... 10 2015 116 225

(51) Int. Cl.
*B65B 17/02* (2006.01)
*B65B 35/44* (2006.01)
*B65B 35/46* (2006.01)

(52) U.S. Cl.
CPC ..... *B65B 17/02* (2013.01); *B65B 35/44* (2013.01); *B65B 35/46* (2013.01)

(58) Field of Classification Search
CPC ..... B65B 17/02; B65B 35/46; B65B 35/44; B65B 41/005; B65G 41/007
See application file for complete search history.

(56) References Cited

U.S. PATENT DOCUMENTS

2014/0352868 A1* 12/2014 Ehmer ..... B65B 17/02 156/60

FOREIGN PATENT DOCUMENTS

| | | |
|---|---|---|
| DE | 10 2012 100 810 | 6/2013 |
| DE | 10 2013 110012 | 11/2014 |
| DE | 10 2014 100946 | 1/2015 |
| DE | 10 2013 113305 | 6/2015 |
| EP | 2 258 625 | 12/2010 |
| JP | 2003-276 705 | 10/2003 |

* cited by examiner

*Primary Examiner* — Christopher T Schatz
(74) *Attorney, Agent, or Firm* — Occhiuti & Rohlicek LLP

(57) ABSTRACT

Rotating conveyor circuits that carry containers to be formed into packaging units to a binding-and-packing station that has parallel binding guides supported by carriers. Each binding guide has a deflection element facing the circuits. Coupling elements provide jointed connections between the binding guides and the circuits. An adjustment mechanism adjusts a channel width between the binding guides such that the binding guides remain parallel.

15 Claims, 3 Drawing Sheets

APPARATUS FOR FORMING PACKAGING UNITS

RELATED APPLICATIONS

This is the national stage under 35 U.S.C. 371 of international application PCT/EP2016/068707, filed on Aug. 4, 2016, which claims the benefit of the Sep. 25, 2015 filing date of German application DE 102015116225.3, the contents of which are herein incorporated by reference.

FIELD OF INVENTION

The present invention relates to an apparatus for forming packaging units from containers.

BACKGROUND

In the packaging industry, it is often useful to form packaging units made from two or more containers. Usually, the containers are arranged in a rectangular array and attached to each other in some way. One way to attach the containers together is with adhesive spots.

SUMMARY

In one aspect, the invention features a transport-and-treatment station, such as a gluing station and/or an alignment station, that has at least two rotating conveyor circuits that are mounted on a mounting frame and that can be driven by a rotational drive. The conveyor circuits are provided at their circumferences with receptacles for the containers. These receptacles are arranged along the circumference region of each conveyor circuit. A gluing station applies adhesive onto a circumferential region of the containers.

The apparatus also has a binding-and-packing station that has at least two parallel binding guides for the containers and that opens in the binding-and-packing station between the two conveyor circuits. The apparatus also has a guide device for transferring containers from the conveyor circuits to the binding-and-packing station.

Within the binding-and-packing station, the containers are conveyed with adhesion points facing one another. During conveyance, the adhesive applied in the gluing station hardens, thus completing formation of a packing unit from a plurality of containers. Usually, two containers are transported next to one another in the binding-and-packing station between the binding guides. If, in addition, three containers are adhesively connected in a row, then, for example, packing units of six containers can be formed.

The apparatus also provides a way to adjust for different container diameters. In particular, the binding-and-packing station has at least two carriers arranged next to one another. Each carrier comprises at least one binding guide. Each binding guide has at least one guide path for the grouped guiding of containers. An example of such a guide path is a circulating guide path with deflectors. The guide path hash driven carriage-like carrier or guide elements, or movers, that circulate. Alternatively, the guide path has an endless guide belt that runs between at least two deflectors, of which at least one deflector is driven.

A coupling element connects each carrier to the transport-and-treatment station in such a way that each coupling element is hinged both at the transport-and-treatment station concentric to the axis of rotation of a conveyor circuit and also at the binding-and-packing station concentric to the axis of the inlet-side deflector of the binding guide. This hinge permits pivoting.

The coupling element itself is a rigid lever arm that is flat or tubular. It either has pivots or bearings at both ends or is configured to be capable of being connected to local pivots or bearings.

The apparatus further has two adjustment mechanisms: one for adjusting the pivot angle of at least one of the two coupling elements, and another for adjusting the space of the two carriers in such a way as to ensure that they remain parallel to each other at all times.

As an alternative, at least one coupling element, or both coupling elements respectively, are driven only indirectly, in that the direct adjustment of the two carriers to one another is effected by means of an adjustment mechanism or drive, wherein the parallelism of the carriers to one another is ensured to be retained, analogously to the solution referred to heretofore. In this situation, due to the axial mounting on both sides, the coupling elements follow the movement of the carriers or of the guide path in the Y-direction (transverse to the transport direction) by a pivoting movement, and simultaneously cause a compensation movement of the carriers in the X-direction (transport direction).

Due to the fact that the coupling elements on the one hand are connected exactly concentric to the axis of rotation of the two conveyor circuits of the transport-and-treatment station, preferably on its installation frame, and, on the other, concentric to the deflector on the inlet side (facing towards the transport-and-treatment station) of the binding guide at the binding-and-packing station, preferably to its carrier, the starting points of the binding guides always remain on a circular circumference about the conveyor circuits, such that, in the event of a change in the spaces between the two binding guides, their spacing to the conveyor circuits does not need to be separately adjusted. The apparatus is therefore, to a certain extent, self-adjusting.

In an advantageous further embodiment of the invention, the parallel guide is formed at one end of the connecting segment by the coupling elements and the adjustment mechanism, and at the other end of the connecting segment by the spacing mechanism, which allows for an adjustment of the mutual spaces of the carriers while maintaining their parallelism to one another. The adjustment of the binding-and-packing station to different container sizes is thereby substantially simplified.

The connecting segment describes the segment between the two parallel binding guides.

Preferably, the adjustment drive(s) for the two coupling elements are configured in such a way that the coupling elements are adjusted synchronously and in counter-direction to one another. In this way, the connecting segment of the binding-and-packing station always runs at right angles to the straight connection lines between the conveyor circuits. The geometric correlation of the components of the transport-and-treatment station and the binding-and-packing station to one another therefore remains assured during an adjustment of the spacing interval of the binding guides, due to the synchronous counter-directional pivoting of the two coupling elements. The adjustment of the binding-and-packing station to different container diameters is therefore always self-adjusting. The invention therefore provides a self-adjustment or auto-adjustment of the tangent point between the fixed installed conveyor circuits and the guide device, e.g. deflection on the intake side of the binding-and-packing station, with parallel synchronous adjustment of the two binding guides which form the guide sides of the connecting segment.

Arranged between the binding guides are preferably in each case two containers, next to one another, in such a way that they face one another with at least one adhesion point. During the conveying on the connecting segment of the binding-and-packing station, the adhesion between the two containers then hardens, such that, at the end of the connecting segment, the containers are connected to one another by means of the adhesion points alternately in the form of a packing unit, i.e. as a six pack. Accordingly, all that then remains to be done is for a handle to be applied in order to render the pack capable being handled by the end user. The adhesion points can of course have different geometries that diverge from a simple point, such as strips or circles. This is irrelevant in relation to the invention.

Preferably, the apparatus is provided with an adjustment drive for the synchronous swiveling of the two coupling elements, which leads to an automatic centering of the two binding guides about a horizontal mid-axis between the two conveyor circuits. The binding guides are therefore self-adjusting to the axis of symmetry of the connecting segment. Preferably, the adjustment drive is actuated and controlled by a central control unit of the apparatus, as a result of which all the parameters of the components of the apparatus can be handled centrally. Conversion to different container sizes and/or shapes can therefore be easily carried out.

Preferably, at least one binding guide is held on its carrier by means of a positioning device, wherein the positioning device allows for an adjustment of the position of the binding guide relative to the carrier at least in the conveying direction x of the binding-and-packing station. In this way the binding guides can be adjusted relative to one another in the longitudinal direction.

Preferably, the positioning device allows for an adjustment of the position of the binding guide relative to the carrier in two horizontal directions running transverse to one another in the manner of an X-Y carriage or cross-table. In this way the binding guides can be adjusted relative to their carrier not only in the longitudinal direction but also in the transverse direction, i.e. in relation to one another, if this is required, for example, for a fine adjustment. In this situation it is to be borne in mind that the binding guides are responsible for exerting a precisely calibrated amount of pressure onto the two containers arranged next to one another on the connecting segment such that the adhesion point or points between the two containers lead to the most precisely defined adhesive bonding possible. It is therefore necessary for the pressure exerted by the binding guides onto the containers located next to one another to be adjusted exactly.

It is also possible for the adjustment of the spacing interval of the binding guides relative to one another to be carried out solely by synchronous counter-directional swiveling adjustment of the two coupling elements at the one end of the binding guide and a synchronous adjustment of the spacing interval of a spacing interval mechanism at the other end of the binding guide, wherein the latter two carriers are connected to one another with an adjustable spacing interval.

In one embodiment, each coupling element is provided with its own adjustment mechanism or adjustment drive, whereby in principle it is also possible to provide for a common adjustment mechanism for both coupling elements, which allows for a synchronous counter-directional adjustment of both coupling elements. Here too, the symmetrical synchronous adjustment of the two spacer guides during an adjustment of the system is carried out automatically. The system is therefore self-adjusting when an adjustment is carried out.

Preferably, the adjustment mechanism takes effect on the pivot joint of the coupling element on the transport-and-treatment station side, on the axis of rotation of the conveyor circuit, onto a ring section connected to the coupling element, which runs concentrically to the axis of rotation of the conveyor circuit. The adjustment mechanism can be provided, for example, by way of a drive motor with a pinion, which meshes with a tooth arrangement on a circulating edge of the ring section. In this way, in particular with the use of a servomotor, a very precise and rapid adjustment is possible of the pivot position of the coupling element relative to the installation frame of the transport-and-treatment station. Preferably, of course, both coupling elements can be adjusted in this manner, wherein both the motors, which in each case form the adjustment mechanism for a coupling element, are then driven synchronously and in counter-direction to one another by means of a common control device.

Preferably, the coupling element is mounted on the assembly frame of the transport and handling station by means of a ball bearing, which is arranged concentrically to the axis of rotation of the conveyor circuit. In this way, a concentric pivoting capability about the axis of the conveyor circuit can be most easily achieved.

In one advantageous and relatively simple embodiment of the invention, the coupling element is formed by a longitudinal brace, provided in the end regions of which are the corresponding components for the pivotable connection to the assembly frame of the transport-and-treatment station and to the carrier. The coupling element can be, for example a longitudinal full or hollow profile element made of metal.

Preferably, the carrier is formed by a frame, which has the advantage that one or more x-y carriages can be fitted for the adjustable holding of the binding guides.

It should still be noted that each binding guide is formed by at least two rotating rollers running about vertical axes, over which a guide belt runs in a horizontal plane, wherein, however, the belt itself is oriented vertically. In addition, a rotation drive is provided for at least one deflection, such that the guide belts that form the binding guides can be actuated at a speed which is adjusted to the rotation speed of the conveyor circuit. The guide belts of both binding guides are of course driven at the same speed and in counter-direction to one another. It is of course possible to provide guides between the deflections on the side of the guide belts facing away from the containers, which press the guide belts against the containers, in order that, by way of the guide belts, an adequate pressure can be exerted onto the containers present on the connecting segment. The connecting segment is preferably a double segment, i.e. at least two containers are arranged next to one another in this segment, between which in each case at least one adhesive point is arranged, which was applied in the conveyor circuits.

Each binding guide can of course be formed by a plurality of guides arranged behind one another, wherein a corresponding plurality of deflections and guide belts are then to be provided. As a result, the connecting segment can also run over corners. Moreover, a connecting segment does not necessarily have to run exactly linear, but can also run in curved fashion. Individual components of the invention, such as described in the claim, can be provided individually or as pluralities. Moreover, all the adjustment drives and other drives, for example for the conveyor circuit, and the deflections of the binding guides, are preferably to be controlled by one control unit, which as far as possible is configured centrally for the entire apparatus for the formation of packing units, in order for as many driven components to be controlled synchronously and in concordance with one another.

In an alternative embodiment, in which at least one coupling element or both coupling elements are driven only indirectly, as referred to heretofore, the adjustment mechanism can be configured for motor or manual drive, and takes effect on the connecting segment or its carrier respectively, in particular on parts of the X-Y adjustment unit, such as the cross-carriage.

Ideally, in this situation a linear drive is provided for, such as a linear drive as referred to, by means of one or more threaded rods.

BRIEF DESCRIPTION OF THE DRAWINGS

These and other features of the invention will be apparent from the following detailed description and its accompanying figures, in which.

DETAILED DESCRIPTION

Figure 1:
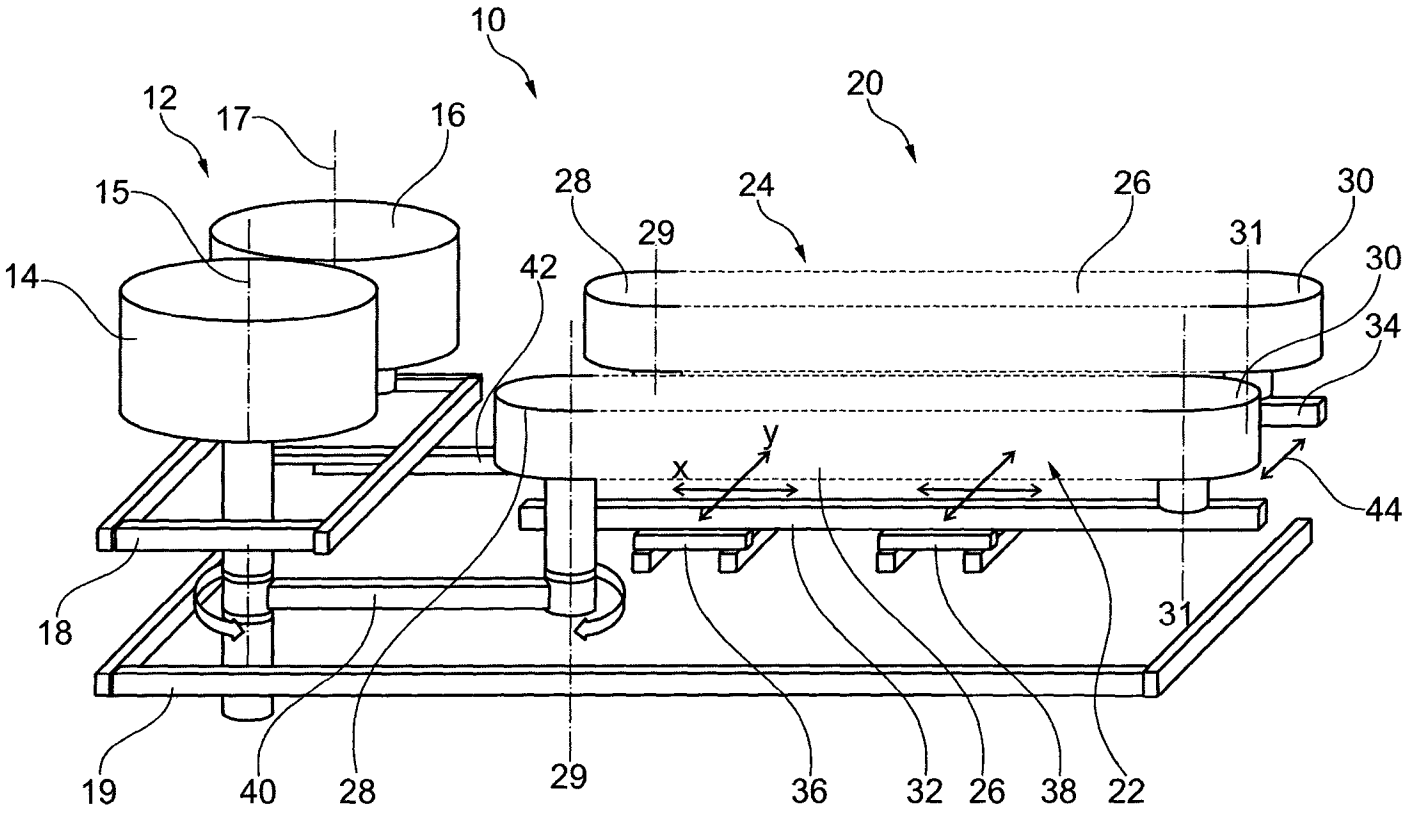
FIG. 1 is a perspective view of a gluing station with two binding guides that are held on separate carriers at an adjustable mutual spacing interval.

FIG. 1 shows an apparatus 10 for forming packaging units from containers, such as bottles or cans. The apparatus 10 includes a transport-and-treatment station having a gluing station 12 at which first and second conveyor circuits 14, 16 are mounted so as to rotate relative to first and second assembly frames 18, 19. In some embodiments, the first and second assembly frames 18, 19 are parts of a common carrying-and-supporting structure. To avoid visual clutter, details of the carrying and supporting structural parts have been omitted.

The first and second conveyor circuits 14, 16 each take up containers at circumferences thereof and provide the containers with adhesion points so that they can ultimately be connected to form a packaging unit. Once the containers have been provided with adhesion points, a deflection arrangement transfers them from the gluing station 12 onto first and second parallel binding guides 22, 24 of a binding-and-packing station 20. It is here that the containers are joined together to form the packaging unit.

Each binding guide 22, 24 has a guide path that extends along a longitudinal direction X for circulating, holding, and carrying carriages. Alternatively, each binding guide 22, 24 has a circulating endless guide belt 26 that is guided about first and second deflection elements 28, 30. The first deflection element 28 has its axis of rotation 29 at the beginning of the binding-and-packing station 20. The second deflection element 30 has it axis of rotation 31 at the end of the binding-and-packing station 20.

The various driven carriers, guide elements, and movers, such as carriages, are omitted from the figure in the interest of clarity. For similar reasons, the figure omits holding devices, and/or forming bodies for stabilizing the locations of grouped containers.

First and second cross-carriages 36, 38 hold the binding guides 22, 24 to corresponding carriers 32, 34. A guide device defines a connecting segment between the two binding guides 22, 24. At least two containers are arranged on this connecting segment next to one another or behind one another with their adhesion points facing each other. The binding guides 22, 24 press these containers against each other to form groups of containers. A typical group has six containers.

As the containers are transported down the connecting segment, the adhesive hardens. Thus, by the time the containers reach the end of the connecting segment, a packaging unit will have formed. This packaging unit consists of several containers. In particular, the packaging unit includes at least the two containers arranged in the connecting segment next to one another or behind one another.

Each carrier 32, 34 has a proximal end and a distal end. The proximal end faces the gluing station 12. The distal end faces away from the gluing station 12. The first deflection elements 28 are disposed at the proximal ends and the second deflection elements 30 are disposed at the distal ends.

Coupling elements 40, 42 couple corresponding ones of these proximal ends to the first assembly frame 18 of the gluing station 12.

Each coupling element 40, 42 has a first end and a second end. A first joint connects the first end of the coupling element 40, 42 to the first assembly frame 18. This first joint permits the coupling element 40, 42 to pivot about the first assembly frame 18 coaxially with the axis of rotation 15, 17 of a conveyor circuit 14, 16. A second joint connects the second end of the coupling element 40, 42 to the proximal end of a corresponding carrier 32, 34, so that the second joint's axis is coaxial with the axis of a corresponding one of the first deflection elements 28.

The two coupling elements 40, 42 are adjustable about the axis of rotation 15, 17 of their respective conveyor circuits 14, 16. It is particularly useful if two coupling elements 40, 42 are adjustable together but in opposite directions along a transverse direction Y. This permits adjustment of space between the two carriers 32, 34 of the binding-and-packing station 20, and therefore also the space between the two binding guides 22, 24. This also maintains the arrangement of the connecting segment relative to the conveyor circuits 14, 16, and therefore of the transfer points for a guide device that transfers the containers from the conveyor circuits 14, 16 onto the connecting segment.

At the distal end of the binding-and-packing station 20, a spacer 44 adjusts the space between the two carriers 32, 34. By controlling the spacer 44 and the adjustment mechanism for the counter-directional pivot position of the two coupling elements 40, 42 together, it becomes possible to maintain parallelism of the two binding guides 22, 24 or their carriers 32, 34 regardless of the space between them.

Figure 2:
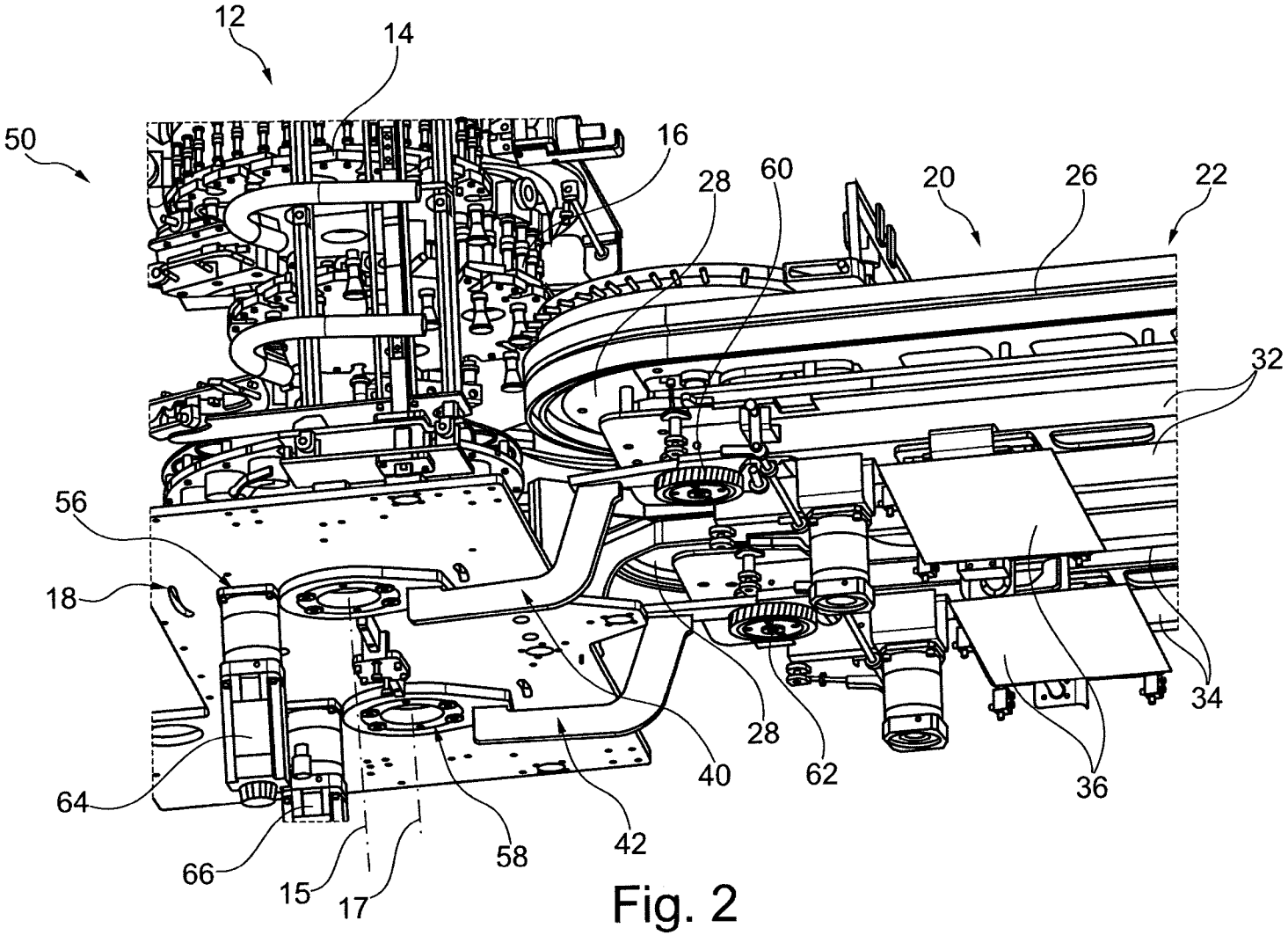
FIG. 2 is a perspective view of the connection of the carriers of two binding guides with the assembly frame of a gluing station.

FIG. 2 shows a perspective view of an apparatus 50 for forming packaging units. Components that are identical or or have the same function as corresponding components in FIG. 1 are provided with the same reference numbers.

The apparatus 50 from FIG. 2 has a first gluing station 12 and a second gluing station 20. The first gluing station 12 is associated with two conveyor circuits 14, 16. The second gluing station 20 is associated with two binding guides 22, 24 that are held on allocated carriers 32, 34.

Coupling elements 52, 54 connect the two carriers 32, 34 to the assembly frame 18 of the first gluing station 12. Each coupling element 52, 54 connects via first pivot joints 56, 58 so as to be able to pivot about the assembly frame 18. Each first pivot joint 56, 58 is concentric with a corresponding conveyor circuit 14, 16.

On the side of the binding-and-packing station 20, second pivot joints 60, 62 hold each coupling element 52, 54. Each second pivot joint 60, 62 is preferably arranged concentrically with a corresponding first deflection element 28 of the binding guide 22, 24 at the gluing station-side end of the binding-and-packing station 20.

In the region of the two first pivot joints 56, 58, an adjustment drive 64, 66 is formed at the assembly frame 18. A microprocessor adjusts the adjustment drive 64, 66 to cause synchronous counter-directional pivoting of the two coupling elements 52, 54.

Figure 3:
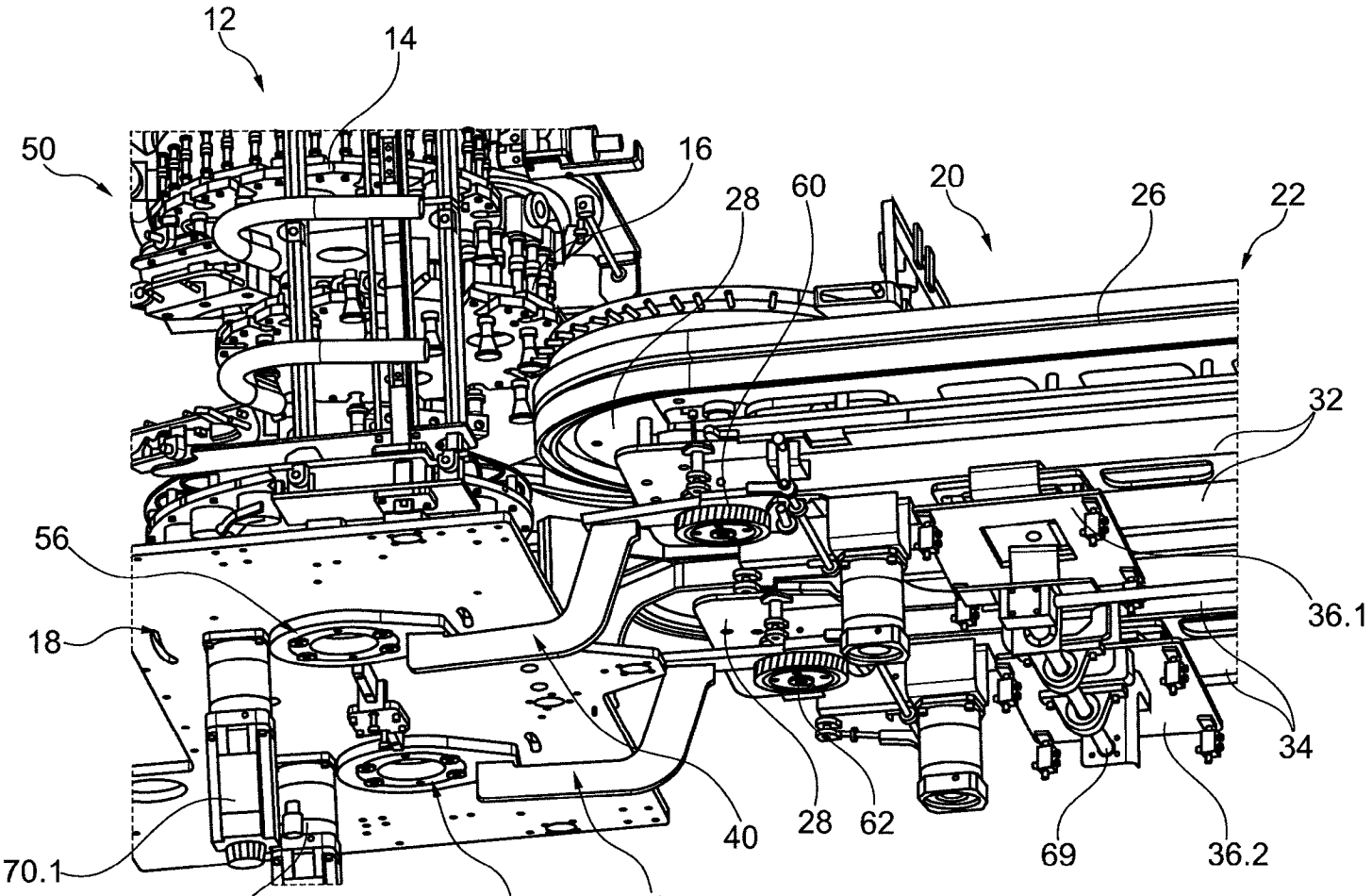
FIG. 3 is a perspective view of an alternative drive for the transverse adjustment of the binding guides.

FIG. 3 shows an arrangement analogous to the exemplary embodiment from FIG. 2. In this situation, however, first and second motors 70.1, 70.2 provide the drive and rotation of the two conveyor circuits 14, 17.

A linear drive 69 adjusts the binding guides 22, 24 or the carriers 32, 34. This linear drive 69 extends in the transverse direction Y and displaces the two cross-carriages 36.1, 36.2 in the transverse direction Y and does so in such a way that the cross-carriages 36.1, 36.2 move together. The rotary drive of the threaded rod is not represented.

In addition, the carriers 32, 34 on the cross-carriages 36.1 and 36.2, as well as the cross-carriers 38, not represented, are mounted in such a way that the force resulting from the rigid pivotable coupling elements 40, 42 when the drive 69 adjusts in the transverse direction Y also causes a compensating thrust in the longitudinal direction X.

The invention therefore provides a way to automatically adjust the binding-and-packing station to accommodate different container diameters and to do so in a simple way.

Having described the invention, and a preferred embodiment thereof, what is claimed as new and secured by Letters Patent is:

1. An apparatus for forming packaging units from containers, said apparatus comprising a transport-and-treatment station, a binding-and-packing station, coupling elements, and a first adjustment mechanism, wherein said transport-and-treatment station comprises conveyor circuits, wherein said conveyor circuits are driven to rotate, wherein each of said conveyor circuits comprises receivers at a circumference thereof, wherein said receivers being configured to receive said containers that are to be formed into packaging units after being guided during transfer from said conveyor circuits to said binding-and-packing station, wherein said binding-and-packing station comprises binding guides and carriers, wherein said binding guides are disposed downstream of said conveyor circuits, wherein there exists an opening between said conveyor circuits and said binding guides, wherein said binding guides are parallel to each other, wherein each of said binding guides comprises a proximal end and a distal end, wherein said each of said proximal ends faces said transport-and-treatment section, wherein each of said binding guides comprises a first deflection element at said proximal end, wherein said carriers are arranged next to each other, wherein each carrier supports a corresponding one of said binding guides, wherein each of said coupling elements comprises first and second joints for connecting a structure from said binding-and-packing station to one of said conveyor circuits that said transport-and-treatment station comprises, wherein said structure from said binding-and-packing station is selected from the group consisting of the binding guide and the carrier that supports said binding guide, wherein each of said first joints is concentric with an axis of rotation of a corresponding one of said conveyor circuits, wherein each of said second joints is concentric with a corresponding one of said first deflection elements, wherein, as a result of said first and second joints, each of said coupling elements pivots relative to said corresponding one of said first deflection elements of a corresponding one of said conveyor circuits, wherein said first adjustment mechanism adjusts a channel width between said binding guides such that said binding guides remain parallel.

2. The apparatus of claim 1, wherein said coupling elements comprise a first coupling element and a second coupling element, wherein said apparatus further comprises a second adjustment mechanism, wherein said first adjustment mechanism is configured to adjust said first coupling element, and wherein said second adjustment mechanism is configured to adjust said second coupling element.

3. The apparatus of claim 1, further comprising a positioning device configured for enabling adjustment along first and second directions of said binding guides relative to said carriers that support said binding guides, wherein said first and second directions are transverse to one another.

4. The apparatus of claim 1, wherein said binding guides comprise a first binding guide and said carriers comprise a first carrier, wherein said apparatus further comprises a positioning device, wherein said positioning device holds said first carrier on said first binding guide, and wherein said positioning device enables adjustment of said first binding guide along a first direction relative to said first carrier.

5. The apparatus of claim 1, further comprising a cross-carriage, wherein said cross carriage is configured to move said binding guides relative to said carriers that support said binding guides along a horizontal direction.

6. The apparatus of claim 1, wherein said first adjustment mechanism causes said coupling elements to pivot synchronously and in opposite directions.

7. The apparatus of claim 1 wherein said first adjustment mechanism is configured to move said binding guides together.

8. The apparatus of claim 1, wherein each of said coupling elements is formed by a longitudinal brace.

9. The apparatus of claim 1, wherein said conveyor circuits comprise a first conveyor circuit, wherein said coupling elements comprise a first coupling element, wherein said first adjustment mechanism engages said first joint of said first coupling element onto a ring section connected to said first coupling element.

10. The apparatus of claim 1, wherein each of said coupling elements is mounted to said transport-and-treatment station by a corresponding one of said first joints, wherein each of said first joints is concentric with an axis of rotation of a corresponding one of the conveyor circuits.

11. The apparatus of claim 1, wherein said first adjustment mechanism comprises a linear drive wherein said linear drive is configured to adjust said channel width.

12. The apparatus of claim 1, wherein said transport-and-treatment station comprises an assembly frame and wherein each of said first joints provides a jointed connection to said assembly frame.

13. The apparatus claim 1, wherein said transport-and-treatment station comprises a gluing station.

14. The apparatus of claim 1, further comprising application stations, wherein each of said conveyor circuits has at least one of said application stations on a circumferential region thereof and wherein each of said application stations is configured to apply adhesive to containers.

15. The apparatus of claim 1, wherein each of said first joints provides a jointed connection to a carrier of one of said rotating conveyor circuits.

* * * * *